US011498092B2

(12) United States Patent
Fliess

(10) Patent No.: US 11,498,092 B2
(45) Date of Patent: Nov. 15, 2022

(54) DOSING SYSTEM WITH A COOLING DEVICE

(71) Applicant: VERMES MICRODISPENSING GMBH, Holzkirchen (DE)

(72) Inventor: Mario Fliess, Munich (DE)

(73) Assignee: VERMES MICRODISPENSING GMBH, Holzkirchen (DE)

( * ) Notice: Subject to any disclaimer, the term of this patent is extended or adjusted under 35 U.S.C. 154(b) by 0 days.

(21) Appl. No.: 17/278,608

(22) PCT Filed: Sep. 24, 2019

(86) PCT No.: PCT/EP2019/075644
§ 371 (c)(1),
(2) Date: Mar. 22, 2021

(87) PCT Pub. No.: WO2020/069909
PCT Pub. Date: Apr. 9, 2020

(65) Prior Publication Data

US 2021/0354168 A1 Nov. 18, 2021

(30) Foreign Application Priority Data

Oct. 5, 2018 (DE) ..... 10 2018 124 662.5

(51) Int. Cl.
*B05C 11/10* (2006.01)
*B05C 5/00* (2006.01)
*B05C 5/02* (2006.01)

(52) U.S. Cl.
CPC ..... *B05C 11/1034* (2013.01); *B05C 5/001* (2013.01); *B05C 5/0225* (2013.01)

(58) Field of Classification Search
CPC .... B05B 11/1034; B05B 5/001; B05B 5/0225
See application file for complete search history.

(56) References Cited

U.S. PATENT DOCUMENTS 9,904,298 B2 2/2018 Fliess et al.
10,022,744 B2 7/2018 MacIndoe et al.
(Continued)

FOREIGN PATENT DOCUMENTS

DE 102016014943 A1 6/2018
EP 2969248 B1 2/2017
(Continued)

OTHER PUBLICATIONS

International Search Report issued in PCT/EP2019/075644; dated Jan. 30, 2020.

*Primary Examiner* — Vishal Pancholi
(74) *Attorney, Agent, or Firm* — Studebaker & Brackett PC

(57) ABSTRACT

The invention relates to a dosing system (1) for a dosing material having a nozzle (40), a feed channel (44) for dosing material, a discharge element (31), an actuator unit (10) that is coupled to the discharge element (31) and/or the nozzle (40) and has a piezo actuator (60), and a cooling device (2). The cooling device (2) comprises a supply device (21, 24, 26) for feeding a precooled cooling medium into a housing (11) of the dosing system (1). The cooling device (2) is configured for direct cooling of at least one subregion of the piezo actuator (60) and/or at least one subregion of a movement mechanism (14) coupled to the piezo actuator (60) by means of the precooled cooling medium.

17 Claims, 7 Drawing Sheets

(56) References Cited

U.S. PATENT DOCUMENTS

Figure 1:
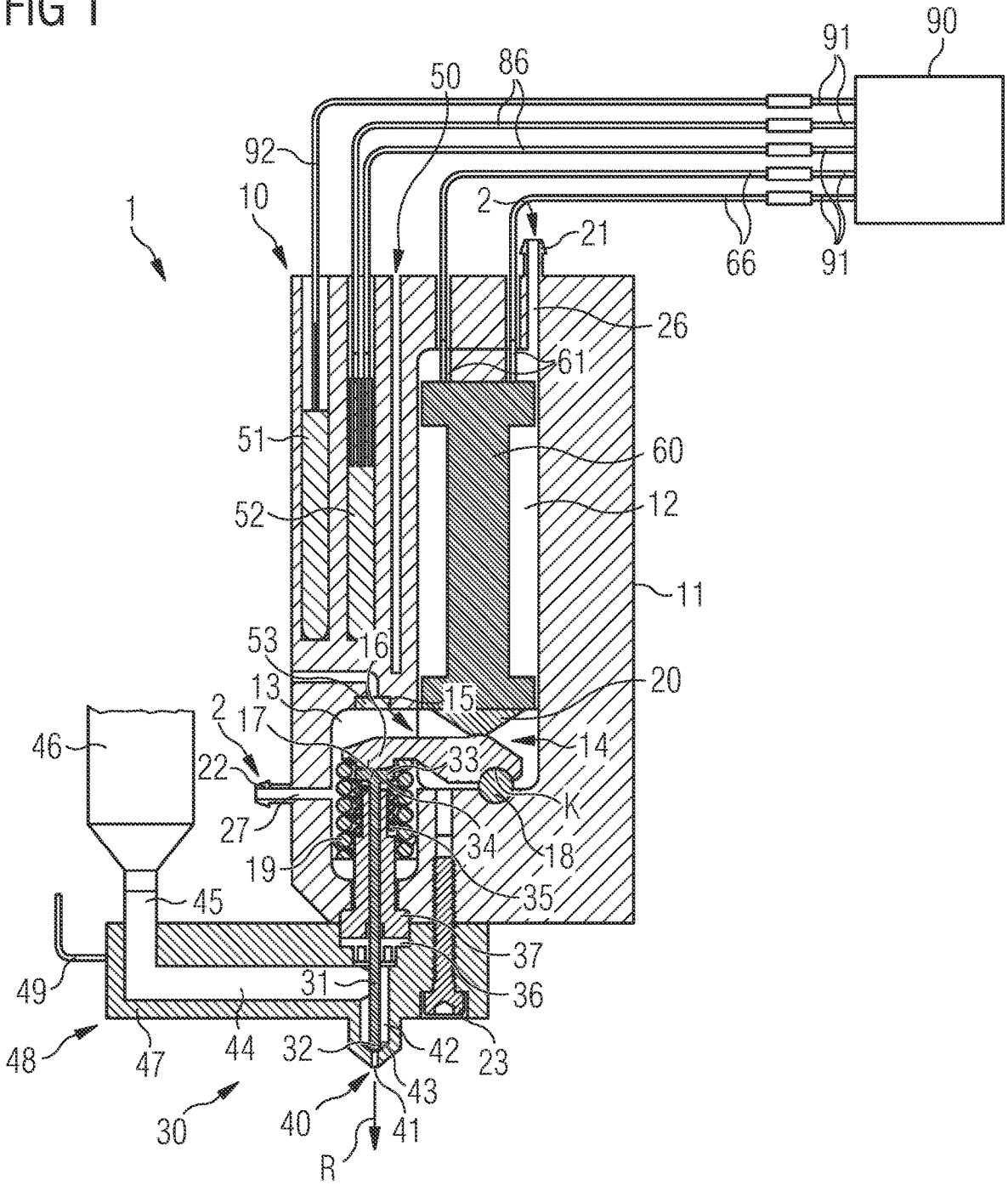

| | | | | |
|---|---|---|---|---|
| 2006/0188645 | A1* | 8/2006 | Forti | B05C 5/001 118/684 |
| 2015/0267728 | A1* | 9/2015 | Fliess | F15D 1/08 29/428 |
| 2015/0300748 | A1 | 10/2015 | Hong et al. | |
| 2016/0004257 | A1 | 1/2016 | Fliess et al. | |
| 2016/0136661 | A1 | 5/2016 | Hong et al. | |
| 2016/0339470 | A1 | 11/2016 | MacIndoe et al. | |
| 2016/0339471 | A1* | 11/2016 | Bittner | B05C 11/1034 |
| 2018/0311697 | A1 | 11/2018 | MacIndoe et al. | |
| 2019/0314847 | A1 | 10/2019 | Fritz et al. | |

FOREIGN PATENT DOCUMENTS

| | | | |
|---|---|---|---|
| EP | 3210674 | A1 | 8/2017 |
| KR | 101150139 | B1 | 6/2012 |
| WO | 2017/213920 | A1 | 12/2017 |

* cited by examiner

DOSING SYSTEM WITH A COOLING DEVICE

The invention relates to a dosing system for a dosing material having a nozzle, a feed channel for dosing material, a discharge element, an actuator unit that is coupled to the discharge element and/or the nozzle and has a piezo actuator, and a cooling device. The invention further relates to a method for operating and a method for manufacturing such a dosing system.

Dosing systems of the type mentioned at the outset are usually used to dose a medium to be dosed, typically a liquid to viscous dosing material, in a targeted manner. In the context of so-called "microdosing technology", it is often necessary for very small amounts of a dosing material to be placed on a target surface with pinpoint accuracy and indeed without touching, that is, without direct contact between the dosing system and a target surface. Such a contactless method is often referred to as a "jet process". A typical example of this is the dosing of glue dots, soldering pastes etc. when assembling circuit boards or other electronic elements, or the application of converter materials for LEDs.

An important requirement here is to deliver the dosing materials to the target surface with high precision, that is, at the right time, at the right place and in a precisely dosed amount. This can be done, for example, by dispensing the dosing material drop by drop via a nozzle of the dosing system. The medium only comes into contact with an interior of the nozzle and a, mostly front, region of a discharge element of the dosing system. A preferred method here is a discharge of individual droplets in a kind of "inkjet process", as is also used, among other things, in inkjet printers. The size of the droplets or the amount of medium per droplet can be determined as precisely as possible in advance through the structure, activation and the targeted effect of the nozzle achieved thereby. Alternatively, the dosing material can also be sprayed on in a jet.

A movable discharge element (usually a tappet) can be arranged in the nozzle of the dosing system. The discharge element can be pushed forward inside the nozzle at a relatively high speed in the direction of a nozzle opening or outlet opening, whereby a drop of the medium is discharged and then withdrawn again.

Alternatively, the nozzle of the dosing system itself can be moved in a discharge or retraction direction. To dispense the dosing material, the nozzle and a discharge element arranged inside the nozzle are moved towards or away from one another in a relative movement. The relative movement can take place either solely through a movement of the outlet opening or the nozzle or at least partially also through a corresponding movement of the discharge element.

Usually, the discharge element can also be brought into a closed position by fixedly connecting it to a sealing seat of the nozzle opening in the nozzle and temporarily remaining there. In the case of more viscous dosing materials, it may also be sufficient for the discharge element to simply remain in the retracted position, that is, away from the sealing seat, without a drop of the medium escaping.

The present invention can be used with all of the aforementioned variants independently of the specific discharge principle, that is, using a jet process, an open inkjet process, a classic closure element or a nozzle configured to be movable.

The discharge element and/or the nozzle are typically moved with the aid of an actuator system of the dosing system. In order to transmit the force generated by the actuator system to the discharge element, the dosing system typically comprises a movement mechanism coupled to the actuator system and the discharge element. The movement mechanism can, for example, be implemented by means of a lever on which the actuator system is supported. The lever itself can rest on a lever bearing and can be tilted about a tilt axis such that the movement of the actuator system is transmitted to the discharge element via a contact surface of the lever. Depending on the specific discharge principle, the movement mechanism can also be configured to transmit the force generated by the actuator system to move the nozzle.

The actuator system can be implemented in various ways, wherein piezo actuators preferably are used, particularly in applications that require extremely fine dosage resolution. Piezo actuators, which are also referred to as piezoelectrically operated actuators, have, with respect to other types of actuators, for example, hydraulically, pneumatically and/or electromagnetically operated actuators, the advantage of very precise and, above all, fast controllability. Piezo actuators are advantageously distinguished by extremely short reaction or response times, which are usually significantly below the corresponding values of other actuator principles. A further advantage is that piezo actuators, with respect to other types of actuators, take up comparatively little space within a dosing system. Piezo actuators thus offer an efficient solution for the operation of dosing systems, particularly with extremely fine dosing requirements.

Irrespective of these advantages, piezo actuators represent components in which large power dissipations are realized, which can cause the piezoelectric material to heat up considerably. Since piezo actuators have a temperature-dependent behavior, heating of the actuator material can affect the longitudinal extension of the piezo actuator in the resting (non-expanded) state as well as the deflection of the live piezo actuator. In addition to the piezo actuator, the components of the movement mechanism can also heat up during operation of the dosing system due to the frictional heat generated, particularly with high-frequency dosing requirements.

A thermally induced expansion of one or more of the aforementioned components can lead to an undesirable change in the stroke process of the discharge element, so that the amount of dosing material dispensed in each case can increasingly deviate from a target value during operation of the dosing system. As a result, the temperatures of the piezo actuator and the movement mechanism can have a direct effect on the precision of the dosing system.

In order to counteract heating of the piezo actuator, the entire piezo actuator can be configured with compressed room air or compressed air flowing around it, since compressed air is available in most dosing systems anyway. There is no separate flow against the movement mechanism, but rather exhaust air of the piezo actuator flows around it. It has been found to be disadvantageous that as the ambient temperature of the dosing system increases, the compressed air can no longer dissipate enough heat from the piezo actuator to keep the piezo actuator and other temperature-sensitive regions of the dosing system consistently below a temperature that is critical for the precise operation of the dosing system.

It is therefore an object of the present invention to provide a dosing system for a dosing material, a method for operating and a method for manufacturing such a dosing system with which the disadvantages explained above can be avoided and with which the dosing precision of the dosing system is improved.

This object is achieved by a dosing system according to patent claim 1, a method for operating a dosing system according to patent claim 14 and a method for manufacturing a dosing system according to patent claim 15.

A dosing system according to the invention for a liquid to viscous dosing material comprises at least one nozzle, a feed channel for dosing material, a discharge element, an actuator unit that is coupled to the discharge element and/or the nozzle and has at least one piezo actuator to move the discharge element and/or the nozzle, and a cooling device. In the following, the term tappet is used as a synonym for a discharge element, without restricting the invention thereto.

The dosing material can be dispensed from the dosing system according to the invention in one of the ways explained at the outset, that is, the dosing system is not restricted to a specific discharge or functional principle. Correspondingly—as is usually the case—a discharge element movable at relatively high speed for discharging the dosing material from the nozzle can be arranged in the nozzle of the dosing system (particularly in the region of the nozzle, for example, shortly before the outlet opening). Alternatively or additionally, as mentioned, an outlet opening of the dosing system according to the invention can be configured to be movable. Nevertheless, for the sake of better understanding, it is assumed in the following that the dosing material is dispensed by means of a movable discharge element, for example, a tappet. However, the invention is not intended to be limited thereto.

The actuator unit comprises at least one piezo actuator and a movement mechanism which interacts functionally with the piezo actuator and which, as explained above, can preferably comprise at least one lever and one lever bearing. To be distinguished from the actuator unit is a fluidic unit of the dosing system, which comprises the components that come into contact with the dosing material, thus, for example, the feed channel, the nozzle and the tappet.

The movement mechanism of the actuator unit is configured to functionally couple the discharge element to the at least one piezo actuator of the dosing system. The coupling takes place such that the forces and movements exerted by the actuator are passed on such that a desired movement of the discharge element for dispensing the dosing material from the nozzle results. The movement mechanism thus represents a, preferably multipart, force-transmitting coupling at least temporarily in order to convert the deflection of the piezo actuator into a, preferably vertical, movement of the discharge element. Preferably, the coupling between the movement mechanism and the discharge element is not a fixed coupling. This means that both components are preferably not screwed, welded, glued, etc. to one another for coupling.

According to the invention, the dosing system comprises a cooling device having a supply device for feeding a precooled cooling medium into a housing of the dosing system, particularly into a housing of the actuator unit. The housing of the actuator unit delimits the actuator unit with respect to an ambient atmosphere of the dosing system, that is, it forms a casing of the actuator unit and therefore encloses at least one piezo actuator and the movement mechanism of the dosing system.

The supply device according to the invention has a number of, thus, one or a plurality of, connection or coupling points for an (external) cooling medium supply line in a region of the housing, and a feed channel arrangement following the (respective) coupling point and extending into an interior of the housing. The supply device can furthermore comprise a number of components for regulating a volume flow and/or pressure of the cooling medium flowing into the housing, for example, a pump or a proportional valve, and optionally further components.

According to the invention, the cooling device is configured for direct, predominantly selective cooling of at least one subregion of the piezo actuator and/or of the movement mechanism of the actuator unit coupled to the piezo actuator by means of the precooled cooling medium. A "direct" cooling of a subregion means that the respective subregion, particularly its surface, is the focus of the cooling. The precooled cooling medium can preferably stream against or blow onto the respective subregion directly. According to the invention, a subregion is cooled in the housing itself, that is, directly "on site". The cooling does not take place "indirectly" in that the housing or parts thereof are cooled from outside (for example, by means of conduction).

According to the invention, only a single subregion, that is, a limited region or section of a surface of the piezo actuator or of the movement mechanism, can be acted upon using cooling medium in a predominantly selective manner by means of the cooling device. The cooling device can therefore comprise flow-directing elements within the housing, for example, separately activatable flow channels, baffles, fans, etc., in order to guide the cooling medium to a specific subregion in a targeted manner. Correspondingly, there can be regions of the surface of the piezo actuator or movement mechanism that are not included in the subregion to be cooled and are therefore excluded from direct cooling. However, it is preferred for a number of subregions, that is, one or a plurality of subregions, which in total substantially encompass the entire surface of the piezo actuator or the components of the movement mechanism, to be acted upon directly with the cooling medium, so that the invention is described below with reference to this embodiment without being restricted thereto.

Due to the selectivity of the cooling, the cooling medium only directly streams against or blows upon the subregions of the piezo actuator or the movement mechanism to be cooled, for example, their entire surface.

A mere flow of the cooling medium into other regions of the dosing system as (sub) regions of the piezo actuator or the movement mechanism, for example, an outside of the housing, does not fall under the invention. The regions of the housing located inside the housing, for example, the walls which form a chamber surrounding the piezo actuator (actuator chamber) and a chamber surrounding the movement mechanism are not the goal of direct cooling. These regions or surfaces of the dosing system that are not encompassed by a subregion to be cooled therefore do not have cooling medium streaming against or blowing upon them in a targeted manner, but merely "flowing along". This means that the cooling medium necessarily passes through these regions on the way from the supply device to an outlet opening from the housing, wherein the regions themselves are not the focus of the direct cooling by the cooling device.

According to the invention, the cooling device can be configured to selectively cool only a number of subregions of one or a plurality of piezo actuators. This means that the movement mechanism would not be affected by direct cooling. Alternatively, however, the direct cooling could also be directed only to one or a plurality of subregions of the movement mechanism, wherein the piezo actuator would not be included in the direct cooling. The piezo actuator and the movement mechanism can thus advantageously be cooled separately by means of the cooling device according to the invention. Alternatively, however, the cooling device can also be configured to directly cool a number of subregions of the piezo actuator and the movement mechanism as a unit, as is explained later.

In the context of the invention, a precooled cooling medium is to be understood as meaning that the cooling medium has a specifiable (target) temperature, at least at the time of entry into the housing. In this case, the (target) temperature of the cooling medium is lower as a result of cooling, and under certain circumstances also significantly lower than the ambient temperature of the dosing system. The "real" cooling according to the invention with a cooled cooling medium thus differs from compressed room air flowing around the piezo actuator for "cooling purposes". To achieve a specific (target) temperature of the cooling medium, the cooling medium is subjected to cooling or heat dissipation before being fed into the housing, that is, heat or thermal energy is extracted from the cooling medium in a targeted manner, for example, by means of a cold generating device of the cooling device, as is explained later. The precooled cooling medium can preferably have a (target) temperature of at most 18° C., preferably of at most 10° C., particularly preferably of at most 1° C., at the time of entry into the housing.

Advantageously, the dosing system according to the invention can be used to ensure that the process heat generated during operation of the dosing system is dissipated particularly effectively from the piezo actuator or movement mechanism. In contrast to only compressed room air flowing around the piezo actuator, the "real" and targeted or directed cooling according to the invention leads to a significant improvement in the cooling performance, so that significantly more heat energy per unit of time can be dissipated from a surface to be cooled directly with the same volume flow of the cooling medium. As a result, the particularly temperature-sensitive components of the dosing system (for example, piezo actuator and movement mechanism) can be cooled even at high outside temperatures so that the undesired thermally induced expansion of these components explained at the outset is prevented and a consistent high level of precision of the dosing system is achieved. The dosing system can be operated at a maximum dosing frequency even at high ambient temperatures due to the particularly effective cooling. The temperature-sensitive components of the dosing system can further advantageously be cooled in a targeted and selective manner by means of the cooling device, wherein cooling of the remaining components or the housing itself can be dispensed with. The consumption of precooled cooling medium can thus be reduced.

In a method according to the invention for operating a dosing system for the dosing of dosing material, the dosing system comprising a nozzle, a feed channel for dosing material, a discharge element, an actuator unit that is coupled to the discharge element and/or the nozzle and has a piezo actuator, and a cooling device, a precooled cooling medium is fed to an interior of a housing of the dosing system, particularly a housing of the actuator unit, by means of a supply device of the cooling device. According to the invention, one or or a plurality of subregions of the piezo actuator are cooled directly by the cooling device by means of the precooled cooling medium. Alternatively or additionally, at least one subregion of a movement mechanism of the actuator unit coupled to the piezo actuator is cooled directly by the cooling device by means of the precooled cooling medium, that is, in a targeted or focused manner with the cooling medium streamed against or blown upon it. Preferably, a number of subregions which taken together comprise the surface of the piezo actuator and/or of the movement mechanism can be cooled directly. In order to cool a number of subregions directly, the cooling device can be activated and/or regulated accordingly by means of a control and/or regulating unit coupled to the dosing system, as is explained later.

In a method for manufacturing a dosing system for the dosing of dosing material having an actuator unit having at least one piezo actuator, the dosing system is equipped with a cooling device. The cooling device is equipped with a supply device for feeding a precooled cooling medium into a housing of the dosing system. According to the invention, the dosing system, particularly the cooling device, is configured so that at least one subregion of the piezo actuator and/or a movement mechanism coupled to the piezo actuator can be cooled directly by means of the precooled cooling medium when the dosing system is in operation.

Further, particularly advantageous embodiments and developments of the invention emerge from the dependent claims and the following description, wherein the independent claims of one claim category can also be developed analogously to the dependent claims and embodiments of another claim category and particularly individual features of various embodiments or variants can also be combined into new embodiments or variants.

The at least one piezo actuator of the dosing system can comprise an actuator housing which is configured to be flexible at least in sections, for example, a fold-like metal bellows in which a number of piezo elements are hermetically encapsulated. This means that the actually "active" piezo actuator, preferably a monolithic piezoceramic multilayer actuator having a number of stacked layers of a piezoelectrically active material, can be arranged inside a separate actuator casing (as actuator housing) so that the stack of piezo elements (piezo stack) is completely sealed off from the actuator chamber or the dosing system. Since the actuator casing is permanently connected to the piezo stack encapsulated therein or the two components form a functional unit, the actuator casing is considered a part of the piezo actuator within the scope of the invention.

The actuator casing of the at least one piezo stack is preferably configured so that no materials or substances can penetrate the actuator casing from the outside inwards or in the reverse direction, even when the dosing system is in operation, that is, when the piezo stack is deflected. In particular, the actuator casing is configured such that it is impermeable to water or moisture in general. Due to the encapsulation, in this embodiment of the invention, at least one subregion of an outer surface or outside of the actuator casing facing away from the piezo stack, preferably its entire surface, has cooling medium streamed against or blown upon it.

In order to cool the encapsulated piezo stack particularly efficiently, a heat-conducting medium surrounding the piezo stack for dissipating heat from a surface of the piezo stack can be arranged in the actuator casing. The heat-conducting medium can preferably be configured such that heat is transferred from the piezo stack surface by means of conduction and/or convection to the actuator casing, for example, a metal body. The piezo stack surface can preferably constitute a heat transfer surface for a heat source, wherein at least one subregion (to be cooled) of the actuator casing can be configured as a heat transfer surface for a heat sink. Alternatively or additionally, the actuator casing can also comprise a medium for suppressing moisture.

Advantageously, in a dosing system having at least one hermetically encapsulated piezo stack, the piezoelectrically active material is largely completely shielded from harmful external (environmental) influences of the dosing system, particularly moisture, even during operation of the dosing system, whereby the "durability" of the piezo actuator is significantly improved. The particularly effective cooling device of the dosing system ensures that the piezo stack is adequately cooled despite the encapsulation, which can heat up considerably inside during operation. Thus, in addition to the precision, the (uninterrupted) service life of the dosing system can be increased significantly. A liquid or aqueous cooling medium can also advantageously be used for cooling, since condensation on the piezoelectrically active material is prevented due to the hermetically sealed encapsulation.

For the most efficient cooling possible, the cooling device can be configured to directly cool at least one subregion of the piezo actuator and/or the movement mechanism coupled to the piezo actuator by means of a control and/or regulating unit as a function of at least one state parameter of the dosing system generated as a result of operation. This process is also known as thermal regulation. For this purpose, the dosing system is preferably coupled to a control and/or regulating unit. Preferably, a number of subregions, which in total, for example, encompass the entire surface of the piezo actuator or the movement mechanism, combined in terms of control technology to form a unit, can be uniformly regulated as a function of at least one state parameter. The invention is described in the following, without being restricted thereto, on the basis of this embodiment.

The term control is used in the following as a synonym for control and/or regulation. This means that even when one speaks of control, the control can comprise at least one regulating process. In the case of regulation, a control variable (as an actual value) is generally recorded continuously and compared with a reference variable (as a target value). The regulation is usually carried out such that the control variable is approximated to the reference variable. This means that the control variable (actual value) continuously influences itself in the action path of the regulating circuit.

According to the invention, a state parameter can be, for example, a (surface) temperature in at least one subregion of the piezo actuator and/or a (surface) temperature in at least one subregion of the movement mechanism coupled to the piezo actuator and/or a temperature in at least one subregion of an outside of the housing ("outside temperature"). To determine the temperature, the dosing system can comprise one or more temperature sensors, which are preferably coupled to a control unit of the dosing system.

In order to monitor the temperature of the piezo actuator spatially (with as high a resolution as possible), a plurality of temperature sensors can be implemented along a longitudinal extent on the actuator surface of the piezo actuator. If the piezo actuator has an actuator casing in which a piezo stack is encapsulated, a plurality of temperature sensors can also be arranged in different regions of an inner wall and/or outer wall of the actuator casing. Alternatively or additionally, a number of temperature sensors can also be arranged in direct contact with at least one component of the movement mechanism, for example, the lever.

Alternatively, a number of temperature sensors can be assembled in the immediate vicinity of a respective component on or in the housing in order to estimate or extrapolate the temperature of the component. Furthermore, the temperature sensors can also be configured to determine the temperature of an assigned subregion of the movement mechanism or of the piezo actuator from a certain distance, for example, by means of infrared temperature sensors. A relevant state parameter, on the basis of which the control takes place ("control state parameter"), can preferably correspond to an average temperature or a maximum temperature of a number of subregions of the piezo actuator and/or movement mechanism.

A further state parameter can be a length of at least one subregion of the piezo actuator. As explained at the outset, piezo actuators or the individual piezo elements can have a temperature-dependent expansion behavior. Therefore, to monitor the (operating) state of the piezo actuator, at least one so-called strain gauge for monitoring an absolute length and/or a dynamic change in length of the piezo actuator can be attached to the actuator surface. The longitudinal expansion of the entire actuator and a subregion thereof can be monitored by means of the strain gauge. The strain gauge can also be provided inside an actuator casing (for example, in the region of an inner wall) and/or on an outside of the actuator casing.

Additionally or alternatively, a distance between the discharge element, preferably a tappet tip, and the nozzle or a nozzle seat of the dosing system in the open state of the dosing system can also be used as a state parameter for controlling the cooling. Signs of wear can occur in continuous operation of the dosing system, particularly in the region of the tappet tip, which can cause the tappet to shorten. On the other hand, the individual components of the movement mechanism can heat up as a result of friction and expand accordingly. A thermally induced change in length of the actuator, as a result of the coupling with the movement mechanism, can also lead to an actual position of the tappet tip deviating from a target position.

To determine this state parameter, the dosing system can comprise at least one motion sensor, for example, a magnetic sensor for measuring the travel of a movable component. At least one thermally compensated Hall sensor can preferably be arranged in a region of the housing such that the sensor can interact with a magnet of the tappet and/or the lever in order to carry out a preferably vertical travel measurement of the tappet or lever. A position of the tappet tip in the closed state of the dosing system can preferably be compared with a position in the open state in order to determine the actual movement of the tappet or the tappet tip for dispensing the dosing material.

A further additional or alternative state parameter can be the amount of dosing material dispensed by the dosing system in a specific time interval. The piezo actuator can heat up considerably due to the work to be performed, particularly with high-frequency dosing materials being dispensed and/or with highly viscous media. A flow rate of the medium, for example, in the region of the feed channel, can therefore also be taken into account as a state parameter. At least one flow sensor can be arranged in a region of the feed channel to determine this state parameter. Alternatively or additionally, it is also possible for a "learned" (dosing material-specific) state parameter to be stored in the control unit or in the dosing system.

It should be pointed out at this point that the basic concept of controlling and/or regulating the cooling of at least one subregion of the piezo actuator and/or the movement mechanism as a function of at least one state parameter is not limited to the above-mentioned dosing system according to the invention. Rather, the control concept represents an independent sub-aspect of the invention.

The control concept can therefore also preferably be used in dosing systems in which an uncooled cooling medium, for example, compressed room air (thus, no precooled cooling medium in the sense of the invention), flow around the piezo actuator and/or the movement mechanism for "cooling purposes". Preferably, the "cooling" of at least one subregion of the piezo actuator and/or the movement mechanism, thus, the flow around or against a respective subregion for "cooling purposes", as a function of a length of at least one subregion of the piezo actuator and/or a distance between the discharge element and the nozzle of the dosing system and/or an amount of dosing material, can be controlled.

The aforementioned state parameters provide essential information about the current (operating) state of the actuator unit and can therefore be used for appropriate compensation measures as part of a comprehensive temperature management of the dosing system. The direct cooling of at least one subregion of the piezo actuator and/or movement mechanism can be controlled, preferably regulated, such that at least one state parameter that requires regulation in these subregions is kept consistently stable in a non-critical region during operation of the dosing system, particularly also under load fluctuations of the piezo actuator, that is, corresponds to a predetermined target value. The target value is preferably not exceeded or undershot as a result of the regulation. Alternatively, the regulation can also take place such that the state parameter is continuously kept in a target range during operation.

For regulation, a corresponding target value or target range can be assigned to the respective state parameter as the actual value, for example, is stored in the control unit. A different type of target value can be assigned to one and the same state parameter in different regions of the actuator unit. For example, a temperature target value of the piezo actuator could be significantly higher than a temperature target value of the movement mechanism.

The direct cooling of a number of subregions of the piezo actuator can preferably be regulated such that a temperature of the actuator surface (as a target value) constantly corresponds to an ambient temperature of the dosing system during operation of the dosing system. A "thermal constancy" of the piezo actuator can be achieved in this way, whereby a thermally induced longitudinal expansion of the piezo actuator is largely prevented during operation.

In principle, a maximum permissible temperature (during operation) of the piezo actuator can be set as the target value so that the highest possible dosing precision of the dosing system is achieved. The current and/or expected power consumption of the actuator can preferably be taken into account to determine the temperature target value. Due to the poor thermal conductivity of the commonly used piezo material, in the event of strong load fluctuations in the piezo actuator, particularly in the case of an encapsulated piezo actuator, the heat loss occurring inside the piezo actuator or in the piezo stack may not be conducted quickly enough to the outside to the cooled surface of the piezo actuator or the actuator casing. As a result, a temperature gradient may form from a core of the actuator or the piezo stack to its outer surfaces or to the actuator casing. The piezo actuator or piezo stack can therefore change in length despite reaching a target temperature on the surface of the piezo actuator or the actuator casing. Preferably, therefore, the respective power consumption of the piezo actuator can be taken into account, which, for example, is stored in the control unit in order to determine a "corrected" target temperature of the surface (of the piezo actuator or the actuator casing), which prevents a longitudinal extension of the entire piezo actuator even with dynamic load changes of the piezo actuator or the encapsulated piezo stack.

The longitudinal extension of the piezo actuator could also be taken into account directly as a target value, which, as said, can be determined by means of strain sensors. The cooling of a number of subregions of the piezo actuator can preferably be controlled, particularly thermally regulated, such that the piezo actuator has a constant, specifiable piezo actuator length when the dosing system is in operation. Correspondingly, an "output" length of the piezo actuator at room temperature or a maximum tolerable length of the piezo actuator could be used as the target value.

Alternatively or additionally, the direct cooling of a number of subregions of the movement mechanism can be regulated (thermally) such that as constantly as possible, unchanging (target) movement of the discharge element, particularly its tip, is achieved during operation of the dosing system. Correspondingly, a distance between a tappet tip and a nozzle insert or a sealing seat of the nozzle in the open state of the dosing system or a distance covered by the tappet tip per tappet stroke could serve as a target value or target range. It is also conceivable for a maximum permissible "outside temperature" of the housing to be used as a target value.

To regulate the direct cooling, a substantially "real-time comparison" of at least one state parameter with the assigned target value can take place in the control unit. Preferably, a plurality of subregions can be uniformly regulated as a function of only one state parameter, wherein at least one further state parameter is continuously "monitored" by the control unit simultaneously. "Monitoring", for example, makes sense when a respective state parameter (currently) is significantly below an assigned target value, so that a regulation is not (yet) necessary in this regard. As soon as the actual value of the "monitored" state parameter approaches a target value, for example, as a result of changed operating conditions of the actuator, this state parameter could (also) be taken into account for regulating the cooling. The respective state parameters, as a function of which the direct cooling of a number of subregions takes place, can preferably change during the operation of the dosing system.

As part of the temperature management, on the one hand, the intensity of the cooling can be regulated, for example, by regulating a volume flow of the precooled cooling medium flowing into the housing. Consequently, it is also possible to regulate the strength with which the cooling medium acts upon a number of subregions. Alternatively or additionally, the (target) temperature of the precooled cooling medium can also be regulated when it enters the housing. The control unit can be coupled to a cold generating device for this purpose. The intensity of the direct cooling can preferably be adapted dynamically (as required) during operation of the dosing system. The exact "location" of the direct cooling can further be controlled. The piezo actuator and the movement mechanism can preferably be acted upon separately with cooling medium, as is explained in the following.

The cooling device of the dosing system can be configured to cool a number of subregions of the piezo actuator and the movement mechanism jointly, that is, as a unit, directly ("combined cooling"). The cooling device preferably comprises only a single cooling circuit, each having a supply device or discharge device for cooling medium, wherein the cooling circuit jointly comprises the actuator chamber and the chamber of the movement mechanism. This means that subregions of the piezo actuator and the movement mechanism are acted upon with a cooling medium of the same (target) temperature. The direct cooling can preferably be regulated as a function of a state parameter of only one of the two components. For example, the direct cooling of the piezo actuator and the movement mechanism could be regulated exclusively as a function of a surface temperature of the piezo actuator.

For particularly efficient temperature management, however, the cooling device can also be configured to control and/or regulate the direct cooling of at least one subregion of the piezo actuator separately by means of the control unit, particularly separately or independently of the control and/or regulation of the direct cooling of at least one subregion of the movement mechanism coupled to the piezo actuator. The cooling device can therefore preferably comprise two separately configured, independently operated cooling circuits, each having separate supply and discharge devices, which can be fed individually with the precooled cooling medium. The cooling circuit for cooling the piezo actuator can preferably be configured separately, particularly (spatially) separated from a cooling circuit for cooling the movement mechanism. Correspondingly, the control unit can also comprise two separate "cooling regulating or control circuits" in order to detect and process the respective state parameters of the piezo actuator or the movement mechanism separately from one another, that is, to supply the respective cooling circuits with cooling medium and guide the cooling medium to the respective subregions to be cooled.

Preferably, on the one hand, a number of subregions of the piezo actuator, for example, the entire actuator surface, can be cooled by means of the cooling device to a first target temperature so that the most advantageous conditions for the operation of the actuator result or the dosing accuracy is increased.

In an analogous manner, on the other hand, a number of subregions of the movement mechanism, for example, a "head region" of the lever, which comes into contact with the tappet, can be cooled by means of the cooling device to a second target temperature, which can differ from the first target temperature. The separate cooling of these subregions makes it possible to decouple the cooling of the movement mechanism from the often very dynamic cooling requirements of the piezo actuator.

The direct cooling of subregions of the movement mechanism can preferably be regulated (thermally) such that signs of wear of components of the movement mechanism and/or the discharge element can be compensated. For this purpose, it can be advantageous or necessary to take advantage, in a targeted manner, of heating of individual or several components of the dosing system that arises from the operation of the dosing system as part of the temperature management. As mentioned, the movement mechanism can particularly heat up due to frictional heat. The tappet can heat up due to contact with a preheated medium in the region of the tappet tip. Furthermore, the two components can also influence each other thermally through their at least temporary coupling.

A thermally induced expansion of the lever, particularly in a region of the "lever head" and/or of a tappet head of the tappet, can preferably be used to compensate for a wear-related shortening of the tappet in the region of the nozzle in order to keep the target stroke of the tappet (as a state parameter) stable.

When the dosing system is in operation, the tappet protrudes at least partially, particularly with the tappet head, into a chamber of the dosing system surrounding the movement mechanism, so that the cooling medium "flows" through the tappet to cool the movement mechanism. As a result of the separate thermal regulation, the movement mechanism can therefore preferably be cooled less intensively than the possibly strongly heated piezo actuator in order to use the (intrinsic) heat present in the lever and/or tappet to maintain the target stroke of the tappet. The direct flow to the movement mechanism can particularly preferably be regulated such that the target value stroke of the tappet is maintained when there is a "co-flow" of at least subregions of the discharge element.

Advantageously, the temperature management of the dosing system can be used to ensure that the scope and intensity of the cooling of the piezo actuator or movement mechanism are always adapted to the current (operating) state of the actuator unit. In particular, load fluctuations of the piezo actuator can be taken into account in order to correspondingly throttle the cooling capacity in times of lower load on the actuator unit and thus to reduce the consumption of cooling medium.

The decoupling of the cooling of the piezo actuator and the movement mechanism can lead to a further reduction in the cooling medium consumption. Furthermore, this also increases the scope for compensatory measures with regard to signs of wear of the movement mechanism, which can have an advantageous effect on the precision of the dosing system.

In contrast, a dosing system having "combined cooling" offers the advantage of a structural simplification of the cooling device and thus a reduction in the manufacturing costs of the dosing system, since only one common cooling circuit is required for the entire actuator unit. Even with this design, any occurring signs of wear can be compensated for, for example, by means of a selective heating of the movement mechanism, as is explained later.

The precooled cooling medium that is fed to the cooling circuit(s) is preferably formed, that is, cold enough and present in a sufficient quantity in the housing, in order to consistently maintain a predeterminable cooling capacity during operation of the dosing system. The (target) temperature of the cooling medium can preferably be determined by the control unit so (low) that a (respective) initially explained target value in at least one subregion of the piezo actuator and/or the movement mechanism coupled to the piezo actuator is kept stable during operation as a result of the direct cooling.

In order to cool the cooling medium down to a predeterminable (target) temperature, the cooling device can comprise a cold generating device. The cooling device, particularly the supply device, is preferably configured to provide the precooled cooling medium in the actuator chamber and/or the chamber of the movement mechanism in the housing. The cooling device is preferably further configured to distribute the precooled cooling medium in the housing as required. Preferably, the precooled cooling medium also has a specific (target) temperature when it strikes the surface of a number of subregions of the piezo actuator or the movement mechanism.

In order to guide the inflowing cooling medium from a (respective) supply device in a directed manner as possible to the subregion(s) to be cooled and then to a discharge device of the housing, the cooling device can comprise flow-directing elements within the housing, for example, separately activatable flow channels, baffles, fans, etc. Preferably, the cooling device thus comprises at least components to cool a cooling medium to a (target) temperature, to provide the cooling medium in the housing having a (target) temperature, to guide the cooling medium in the housing in a number of subregions of the piezo actuator and/or the movement mechanism, to discharge the cooling medium from the housing and optionally to feed it again to the cold generating device.

The cold generating device for cooling the cooling medium can preferably comprise any type of "active" cold source. The cold source is preferably configured to actively dissipate thermal energy from a substance, for example, a cooling medium, in order to actively "generate" cold. The cooling device can therefore preferably comprise at least one cold source.

The cold generating device can be configured separately, thus, not as a fixed part of an individual dosing system. The cold generating device can preferably interact with a plurality of dosing systems. In order to guide the precooled cooling medium into the housing, the cold generating device can be coupled to at least one connection point of the housing by means of a cooling medium supply line of the cooling device, for example, a temperature-insulated flexible line.

According to a first embodiment, the cold generating device is preferably configured to cool the cooling medium to a specific absolute (target) temperature. The cold generating device can preferably be operated regardless of the temperature and/or humidity of the ambient air of the dosing system or the cold generating device. This means that the temperature of the cooling medium can not only be reduced relative to an ambient temperature by means of the cold generating device, but can also be set to "any" value, that is, what is required with regard to the operation of the dosing system. The cold generating device can preferably make use of the principle of a refrigeration machine (as a cold source). For example, the cold generating device could comprise at least a compression refrigeration system. Such a refrigeration machine can preferably be configured to supply two or more separate dosing systems with cooled cooling medium. Liquid and/or gaseous media are suitable as the cooling medium, wherein cooling media having a high thermal capacity are preferred.

Alternatively and additionally, the cold generating device can make use of the principle of thermoelectric cooling. The cold generating device can therefore preferably comprise at least one Peltier element (as a cold source).

Compressed and (actively) cooled air can preferably be used as the cooling medium, since this can be provided with relatively little effort and can be compatible with the hygroscopic properties of live (unencapsulated) piezo actuators. Therefore, in another embodiment of the invention, the cold generating device can comprise at least one vortex tube (as a cold source) for cooling the cooling medium to a specific (target) temperature. The temperature of the cooled air emerging from the vortex tube can preferably be regulated by means of an adjustable regulating valve in the region of a hot air outlet of the vortex tube. Alternatively or additionally, a volume flow of the air flowing into a vortex chamber of the vortex tube can also be adapted, for example, by means of a proportional valve upstream of the vortex tube, to provide a needs-based amount of precooled cooling medium. The regulating valve or the proportional valve of a respective vortex tube can preferably be regulated by means of the control unit such that the cooling medium is provided with a (target) temperature in the housing. The amount of precooled cooling medium provided by a single vortex tube is preferably sufficient for direct cooling of the temperature-sensitive components of an actuator unit.

According to a further embodiment, the cold generating device can particularly preferably comprise a refrigeration machine, for example, a compression refrigeration system, and at least one downstream vortex tube interacting therewith. The cooling device can preferably also comprise more than one, that is, at least two, different cold sources. Particularly, the plurality of cold sources can be configured to be separately activatable. Preferably, a cooling medium that has already been previously controlled or cooled can be finally cooled to a (target) temperature by means of the vortex tube. As a result of this interaction, the cooling medium can also be cooled to temperatures below the "lowest possible" cooling temperature of a refrigeration machine.

Advantageously, the cold generating device of the cooling device can be used to ensure that there is always a sufficiently large amount of a sufficiently cooled cooling medium present in the housing to be able to keep one or a plurality of state parameters in a number of subregions consistently in a non-critical target range during operation of the dosing system. A very wide or deep control range for cooling can particularly be achieved when a refrigeration machine interacts with a vortex tube. The dosing system can thus be operated with a maximum dosing frequency even under unfavorable environmental conditions, such as particularly high temperatures, wherein high dosing precision is simultaneously guaranteed.

In order to further improve the dosing accuracy, at least one subregion of the movement mechanism of the actuator unit coupled to the piezo actuator can comprise a regulatable heating device for heating at least one subregion of the movement mechanism.

For this purpose, the heating device can be implemented as part of the movement mechanism, for example, in the form of a heating coil in or on the lever.

Alternatively or additionally, the housing of the actuator unit can comprise at least one heating device, which can be regulated by means of the control unit, for heating at least one subregion of the movement mechanism. The subregion can preferably be heated to a predeterminable temperature by means of conduction. The heating device, for example, a heating cartridge or a heating coil can be thermally decoupled from the piezo actuator, for example, by means of an insulating air-filled slot in the housing between the heating device and piezo actuator.

The housing can preferably comprise at least one temperature sensor, particularly in a region between the heating cartridge and the thermal decoupling. As is generally the case with dosing systems of this type, a heating device for heating the nozzle or the dosing material can additionally be provided in the nozzle region.

The heating device is preferably configured to work together with the cooling device of the dosing system to keep one or a plurality of state parameters of the dosing system as constant as possible during operation in a number of subregions of the piezo actuator and/or movement mechanism, preferably in the region of a respective target value. Preferably, the heating device and the cooling device of the dosing system can interact such that a (target) temperature in at least one subregion of the piezo actuator and/or the movement mechanism coupled to the piezo actuator and/or a length of the piezo actuator and/or a distance between the discharge element and of the nozzle in the open state of the dosing system and/or an amount of dosing material is consistently predominantly constant during the dispensing of the dosing material when the dosing system is in operation.

The heating effect and the cooling effect can preferably be coordinated with one another by means of the control unit such that at least one "control state parameter" is kept in a target range in the most efficient way possible during operation of the dosing system. The control unit can preferably comprise a "heating regulating or control circuit" in order to activate the heating device separately, particularly separately from the cooling device.

The heating device and the cooling device can preferably be operated in parallel at least temporarily, that is, a number of subregions can be heated and cooled directly simultaneously ("overlapping regulation"). The "overlapping regulation" preferably takes place such that the consumption of heating energy or cooling medium is as low as possible, that is, the heating device and the cooling device do not continuously work against one another at full load. For example, in a dosing system with "combined cooling", the cooling device could be controlled such that a target value temperature is reached in a region of the actuator surface. In addition, the heating device can be controlled such that a number of subregions of the movement mechanism (and by means of conduction also the discharge element or tappet) are heated to a (higher) target temperature in order to maintain a target value for the stroke of the discharge element.

Alternatively or additionally, the heating device can also be controlled in such a way as to achieve a desired thermally induced expansion in a region of the housing, particularly in a region of the housing enclosing the chamber of the movement mechanism. The thermally induced expansion of at least one region of the housing can preferably take place such that a target value for the stroke of the discharge element is kept stable during operation of the dosing system.

Advantageously, the possibility of wear compensation can be yet further improved by means of a separately activatable heating device, for example, in which a shortening of the discharge element or tappet is compensated for by targeted heating or controlled thermal expansion of individual subregions of the movement mechanism or indirectly also of the tappet and/or the housing. Thus, in the open state of the dosing system, the tappet tip can always be positioned at an initial or target distance from the nozzle, so that the amount of dosing material dispensed per tappet stroke remains constant. Simultaneously, the heating device is configured and arranged in the dosing system such that the relevant state parameters of the piezo actuator (for example, the actuator temperature or length) can also be kept in a non-critical range.

In fact, the aforementioned advantages can also be used in the system of "combined cooling", so that a desired thermal expansion of these regions can be achieved despite a number of subregions of the movement mechanism being acted upon directly by an optionally very cold cooling medium. Thus, despite a structural simplification of the dosing system, a consistently high level of precision can be achieved in the dosing material delivery. In addition, the slight, controlled "working against one another" ("overlapping regulation") of the heating device and cooling device can advantageously contribute to an increased "rigidity" or constancy of a state parameter of the dosing system with respect to external disturbances.

Figure 2:
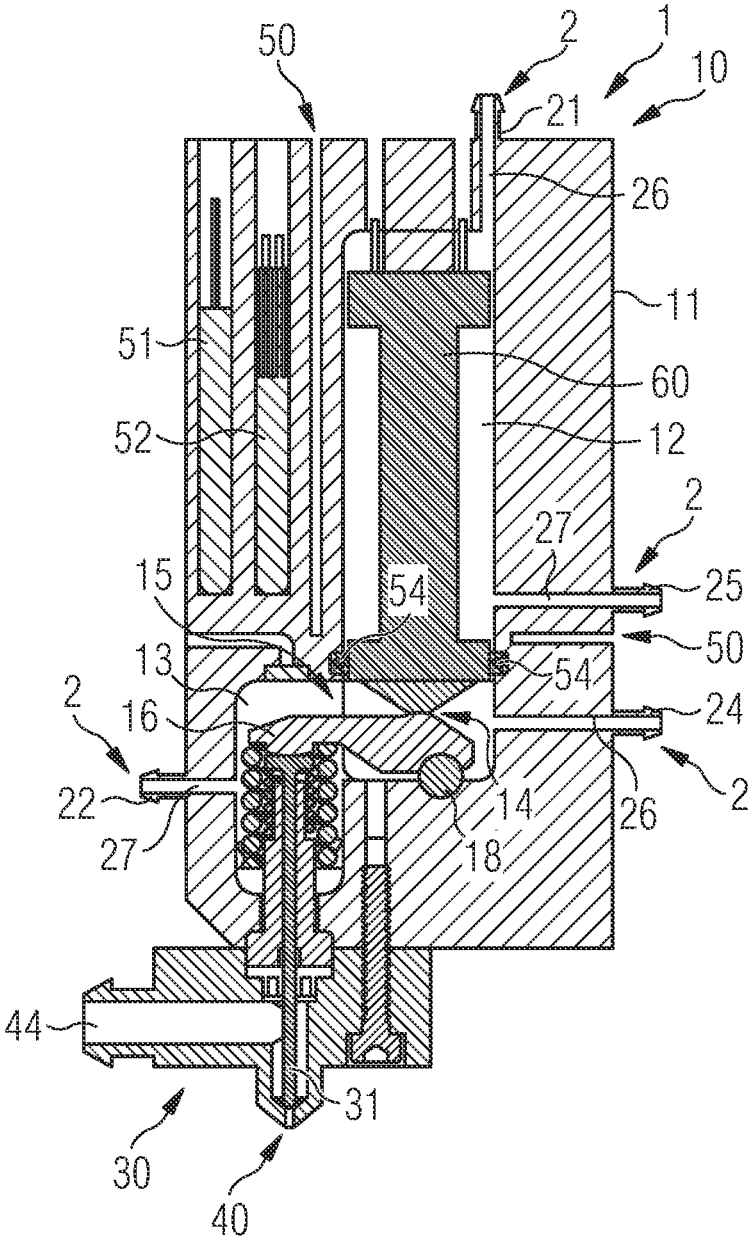
Figure 3:
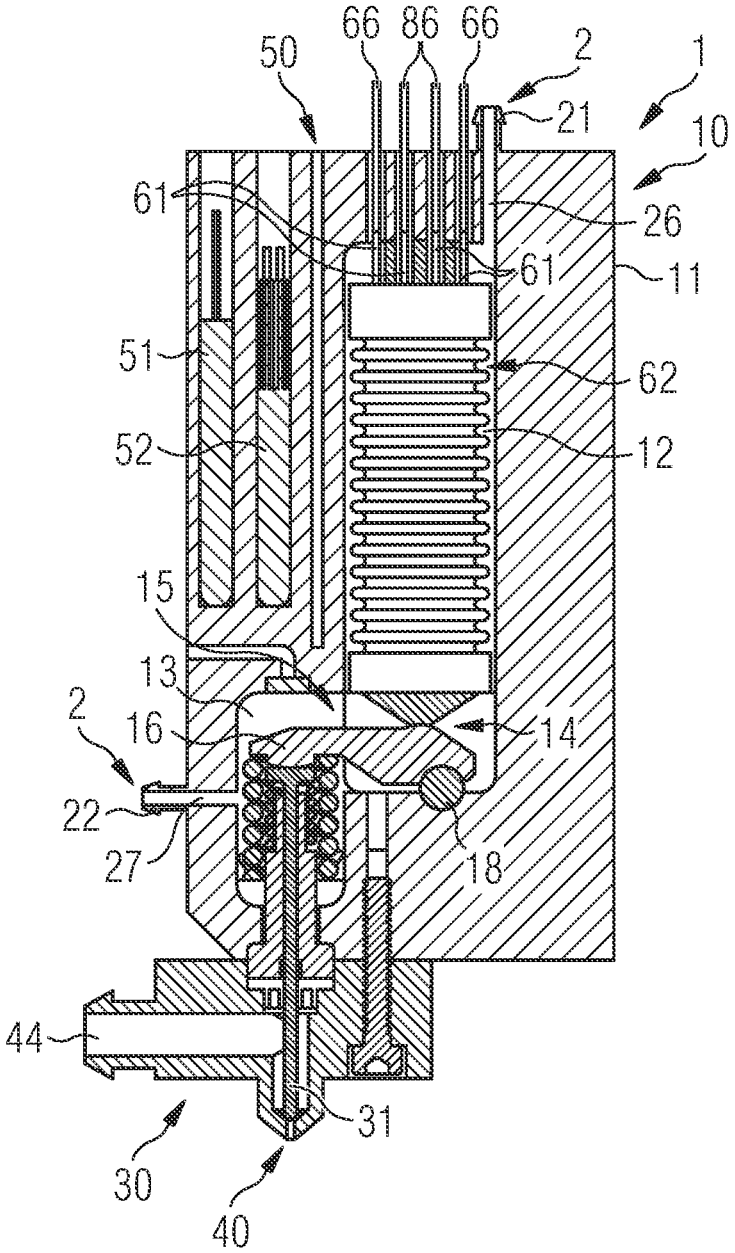
Figure 4:
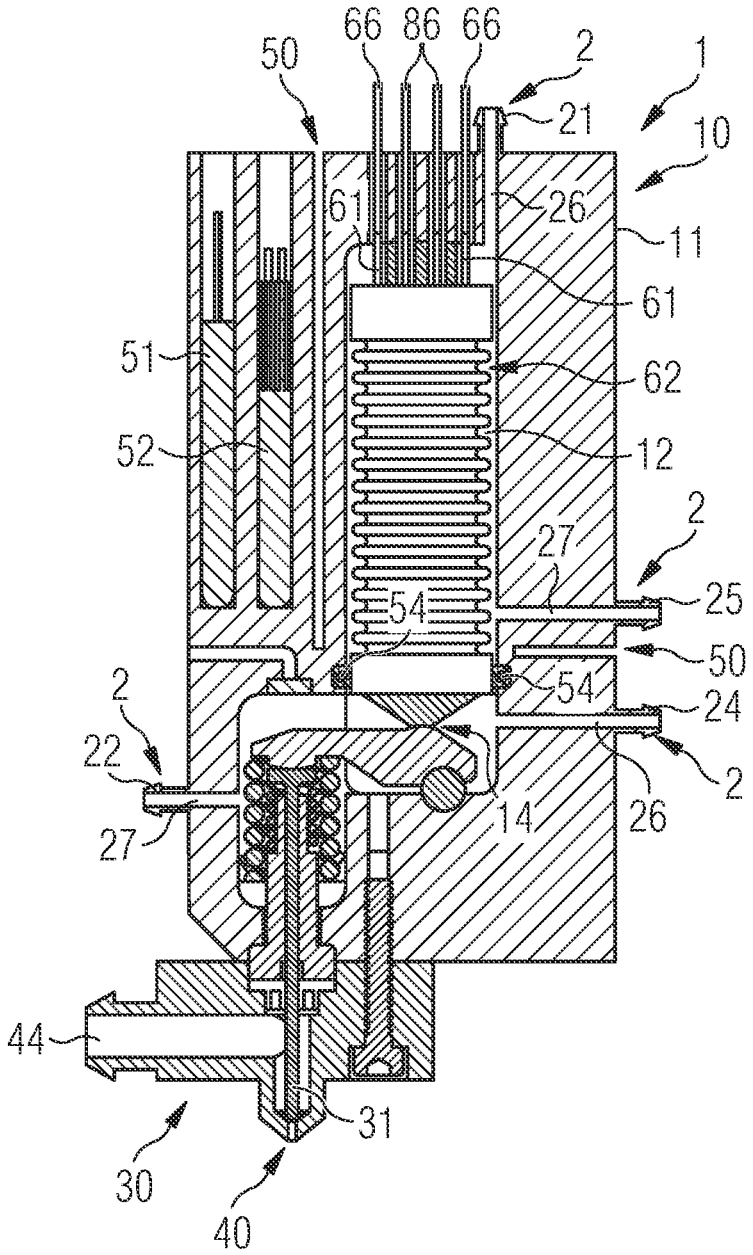
Figure 5:
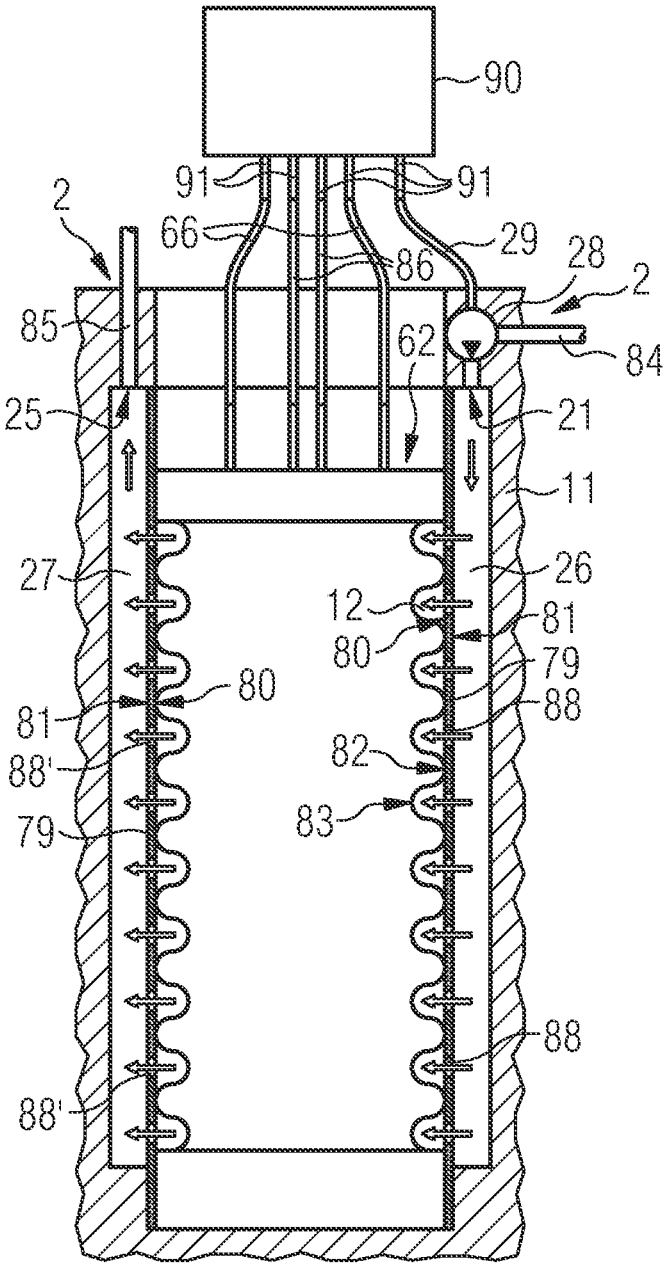
Figure 6:
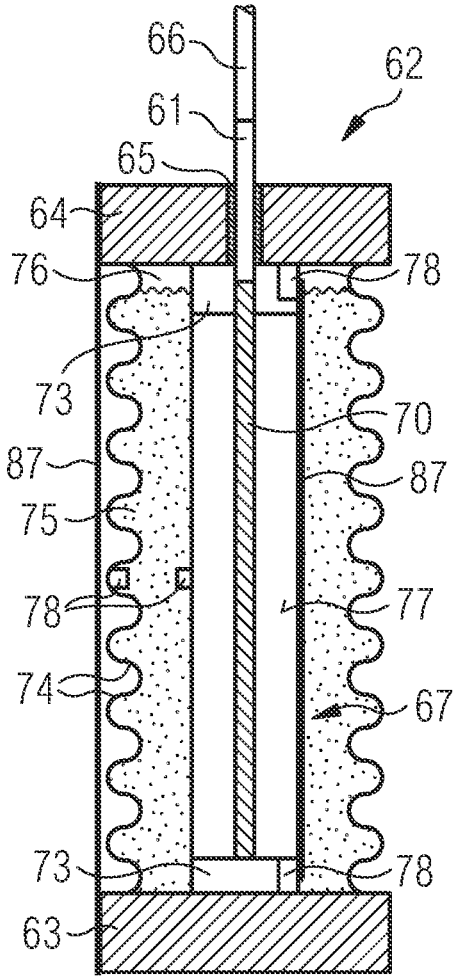
Figure 7:
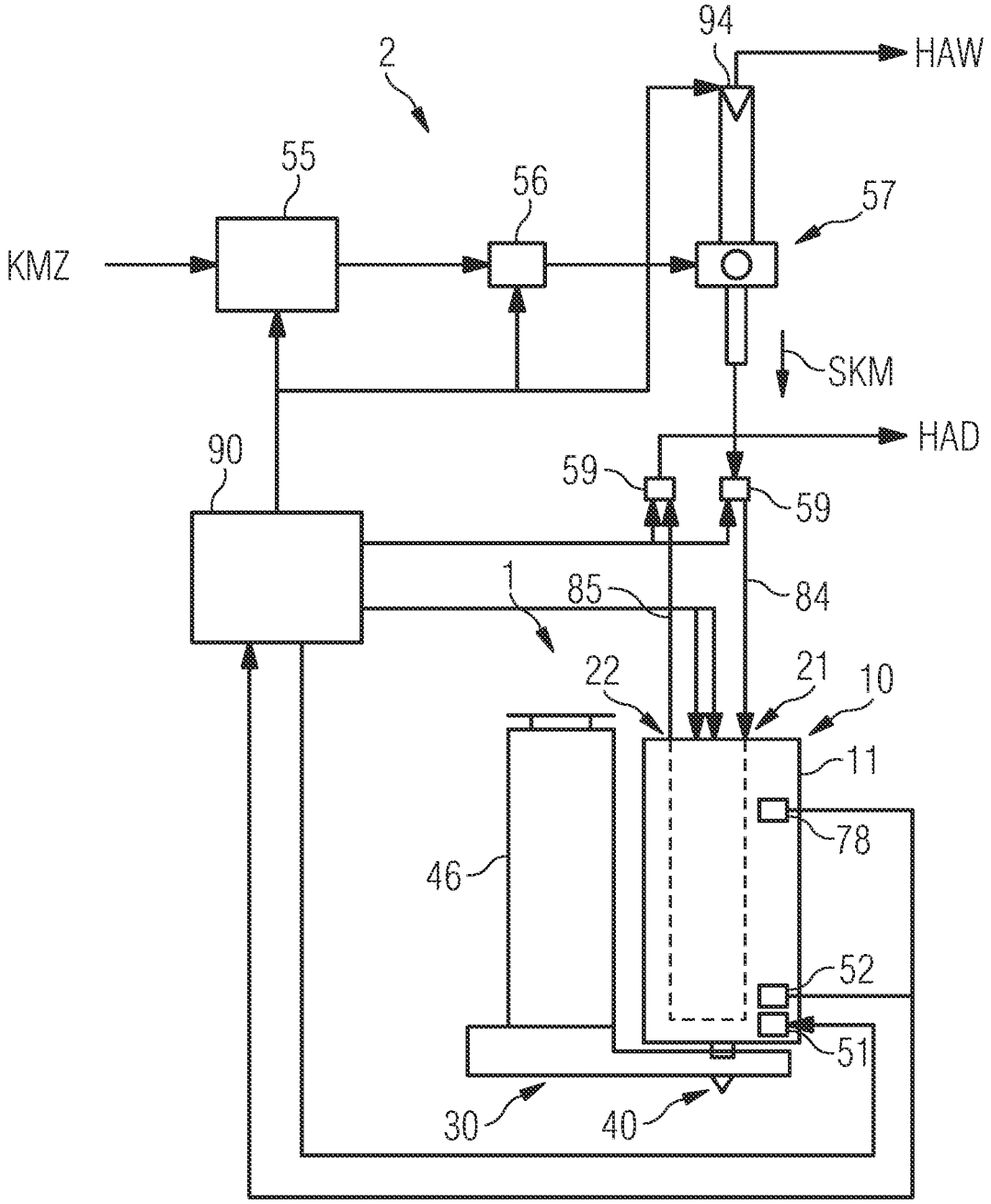

The invention is explained in more detail in the following with reference to the attached figures using embodiments. The same components are provided with identical reference numbers in the various figures. The figures are usually not to scale. Shown are:

FIG. 1 a sectional view of a dosing system according to an embodiment of the invention, FIGS. 2 to 4 parts of dosing systems depicted in section according to other embodiments of the invention, FIG. 5 parts of an actuator unit of a dosing system depicted in section according to an embodiment of the invention, FIG. 6 a sectional view of an encapsulated piezo actuator for a dosing system according to an embodiment of the invention, FIG. 7 a schematic representation of a cooling device for a dosing system according to an embodiment of the invention.

A specific embodiment of a dosing system 1 according to the invention is now described with reference to FIG. 1. The dosing system 1 is depicted here in the usual intended location or position, for example, during operation of the dosing system 1. A nozzle 40 is located in the lower region of the dosing system 1, so that the drops of the medium are discharged downwards in a discharge direction R through the nozzle 40. Insofar as the terms below and above are used in the following, these details therefore always relate to such a, usually conventional, position of the dosing system 1. However, this does not rule out that the dosing system 1 can also be used in a different position in special applications and the drops are discharged laterally, for example. This is basically also possible depending on the medium, pressure and exact construction and activation of the entire discharge system.

The dosing system 1 comprises, as essential components, an actuator unit 10 and a fluidic unit 30. In the embodiment of the dosing system 1 shown here, the actuator unit 10 and the fluidic unit 30 are fixedly connected to one another, for example, by means of a fixing screw 23. It should be noted, however, that the respective assemblies 10, 30 can also be implemented in the manner of plug-in coupling parts that can be coupled to one another to form a quick-release coupling. The actuator unit 10 and the fluidic unit 30 could then be coupled to one another without tools in order to form the dosing system 1.

The actuator unit 10 substantially comprises all components that ensure the drive or movement of a discharge element 31, here a tappet 31, in the nozzle 40, thus, for example, a piezo actuator 60 and a movement mechanism 14, to be able to actuate the discharge element 31 of the fluidic unit 30, and similar components, as is explained in the following.

In addition to the nozzle 40 and a supply line 44 of the medium to the nozzle 40, the fluidic unit 30 comprises all other parts that are in direct contact with the medium, and the elements that are required in order to assemble together the relevant parts which are in contact with the medium or to hold them in their position on the fluidic unit 30.

In the embodiment of the dosing system 1 shown here, the actuator unit 10 comprises an actuator unit housing block 11 having two internal chambers, namely on the one hand, an actuator chamber 12 having a piezo actuator 60 located therein and on the other hand, an action chamber 13 into which the movable discharge element 31, here the tappet 31, of the fluidic unit 30 protrudes. Via a movement mechanism 14, which protrudes from the actuator chamber 12 into the action chamber 13, the tappet 31 is actuated by means of the piezo actuator 60 so that the fluidic unit 30 discharges the medium to be dosed in the desired amount at the desired time. The tappet 31 here closes a nozzle opening 41 and thus also serves as a closure element 31. However, since most of the medium is only discharged from the nozzle opening 41 when the tappet 31 is moving in the closing direction, it is referred to here as the discharge element 31.

The piezo actuator 60 is connected in an electrical or signal manner to a control unit 90 of the dosing system 1 in order to be activated. The connection to this control unit 90 is via control cables 91, which are connected to suitable piezo actuator control connections 66, for example, suitable plugs. The two control connections 66 are each coupled to a contact pin 61 or to a respective connection pole of the piezo actuator 60 in order to activate the piezo actuator 60 by means of the control unit 90. In contrast to what is depicted in FIG. 1, the control connections 66 can be guided through the housing 11 in a sealed manner such that substantially no air can penetrate into the actuator chamber 12 from the outside in the region of the respectively implemented control connections 66, for example, in the context of a direct cooling, described in the following, of a number of subregions of the piezo actuator 60 using a precooled cooling medium. The piezo actuator 60, particularly the piezo actuator control connections 66, can, for example, be provided with a suitable memory unit (for example, an EEPROM or the like) in which information such as an article designation etc. or control parameters for the piezo actuator 60 are stored, the control parameters then being able to be read out by the control unit 90 to identify the piezo actuator 60 and activate in the appropriate way. The control cables 91 can comprise a plurality of control lines and data lines. However, since the basic activation of piezo actuators is known, this will not be discussed further.

The piezo actuator 60 can expand and contract again in the longitudinal direction of the actuator chamber 12 in accordance with a wiring by means of the control device 90. The piezo actuator 60 can be inserted into the actuator chamber 12 from above. A spherical cap that is height-adjustable by means of a screwing movement can then serve as the upper abutment (not shown here), allowing precise adjustment of the piezo actuator 60 to a movement mechanism 14, here a lever 16. Accordingly, the piezo actuator 60 is mounted on the lever 16 in the downward direction via a pressure piece 20 which tapers at an acute angle at the bottom and which in turn rests on a lever bearing 18 at the lower end of the actuator chamber 12. The lever 16 can be tilted about a tilt axis K via this lever bearing 18, so that a lever arm of the lever 16 protrudes through a breakthrough 15 into the action chamber 13. At the end of the lever arm, this has a contact surface 17 pointing in the direction of the tappet 31 of the fluidic unit 30 coupled to the actuator unit 10, which presses on a contact surface 34 of a tappet head 33.

It should be mentioned at this point that in the embodiment shown, it is provided that the contact surface 17 of the lever 16 is permanently in contact with the contact surface 34 of the tappet head 33, in that a tappet spring 35 presses the tappet head 33 against the lever 16 from below. The lever 16 rests on the tappet 31. However, there is no fixed connection between the two components 16, 31. In principle, however, it would also be possible for the tappet spring 35 to be at a distance between the tappet 31 and lever 16 in an initial or rest position, so that the lever 16 initially travels freely through a specific path section when it is pivoted downwards and thereby picks up speed and then with a high impulse strikes the tappet 31 or its contact surface 34 in order to increase the discharge impulse which the tappet 31 in turn exerts on the medium. In order to enable an almost constant pre-tensioning of the drive system (lever piezo actuator movement system), the lever 16 is pressed upwards by an actuator spring 19 at the end at which it comes into contact with the tappet 31.

As mentioned, the fluidic unit 30 is connected to the actuator unit 10 by means of a fixing screw 23. The tappet 31 is supported by means of the tappet spring 35 on a tappet bearing 37, to which a tappet seal 36 connects downwards. The tappet spring 35 pushes the tappet head 33 away from the tappet bearing 37 in the axial direction upwards. A tappet tip 32 is thus also pushed away from a sealing seat 43 of the nozzle 40. That is, without external pressure from above on the contact surface 34 of the tappet head 33, in the rest position of the tappet spring 35, the tappet tip 32 is located at a distance from the sealing seat 43 of the nozzle 40. Thus, a nozzle opening 41 is also free or not closed in the rest state (non-expanded state) of the piezo actuator 60.

The dosing material is fed to the nozzle 40 via a nozzle chamber 42 to which a feed channel 44 leads. On the other hand, the feed channel 44 is connected to a medium reservoir 46 by means of a reservoir interface 45. Furthermore, the fluidic unit 30 can also comprise a series of additional components that are usually used in dosing systems of this type, such as a frame part 47, a heating device 48 with heating connection cables 49 etc., to name just a few. Since the basic structure of dosing systems is known, for the sake of clarity, predominantly those components are shown here which relate at least indirectly to the invention.

The dosing system 1 comprises a cooling device 2 having a supply device 21 in order to feed a precooled cooling medium to the housing 11 of the actuator unit 10. The supply device 21 here comprises a plug nipple 21 or a hose olive 21 as a coupling point for connecting a cooling medium supply line (not shown). In order to guide the cooling medium directly into the actuator chamber 12, thus, without directly cooling a region of the housing 11, the supply device 21 furthermore comprises an inflow channel 26 that follows the plug nipple 21. It should be pointed out that the plug nipple 21 and the inflow channel 26 are only representative of a number of further possible components of a supply device 21 here and also in the following figures. The inflowing cooling medium is directed in a targeted manner to a number of subregions of the piezo actuator 60 within the actuator chamber 12 by means of flow-directing elements (not shown here), so that the cooling medium is preferably blown directly onto the entire surface of the piezo actuator 60.

In this embodiment, the actuator chamber 12 is continuously connected to the action chamber 13. Thus, the cooling medium flowing into the actuator chamber 12, for example, compressed air cooled to a target temperature, can be directed in a targeted manner by the cooling device such that a number of subregions of the movement mechanism are also cooled directly. The cooling device is configured to form a cooling medium flow within the actuator chamber 12 and the action chamber 13 and to direct it such that predominantly only the surfaces of the subregions to be cooled are acted upon with the cooling medium in a focused manner, preferably frontal.

In contrast, other regions of the dosing system 1 that are not to be cooled directly, for example, an outer wall of the housing 11 or an inner wall of the actuator chamber 12 or the action chamber 13, are not blown upon with cooling medium in a focused manner. The latter regions are indeed passed or grazed by the cooling medium ("flowed along"), but there is no flow directly against them, so that the cooling medium does not develop its full cooling capacity here.

The cooling medium leaves the housing by means of a discharge channel 27 of a discharge device 22. The discharge device 22 is configured here as part of the cooling device 2 according to the invention.

Mechanical abrasion from the actuator chamber 12 or action chamber 13 can also be removed from the dosing system 1 by means of the cooling medium flow. In this embodiment of the invention, a number of subregions of the piezo actuator and the movement mechanism are directly cooled together, that is, as a unit, ("combined cooling"). Accordingly, the dosing system 1 here comprises only one cooling circuit.

In principle, the piezo actuator 60 and the movement mechanism 14 can be cooled directly at a constant intensity when the dosing system is in operation ("unregulated cooling"). However, as shown in FIG. 1, it is preferred that the direct cooling is regulated as required by means of the control unit 90. Since the piezo actuator 60 and the movement mechanism 14 are cooled here together or as a unit, the control unit 90 only requires a single control and/or regulating circuit here. For example, the cooling could be regulated as a function of a temperature of the actuator surface (as a state parameter) in order to regulate the piezo actuator 60 to a constant length during operation. For this purpose, the piezo actuator 60 can comprise a number of temperature sensors, wherein the corresponding measured values are fed to the control unit 90 by means of temperature sensor connection cables. This is explained later with reference to FIGS. 3 and 6.

The control unit 90 is coupled to a cold generating device, for example, a compression refrigeration system and/or a vortex tube (see FIG. 7), and controls this as a function of the state parameter so that the housing 11 is fed a sufficiently cooled cooling medium with such a volume flow and distributed in the housing 11 so that the at least one state parameter consistently corresponds to an assigned target value as a result of the direct cooling.

In the embodiment shown in FIG. 1, due to the common cooling of the piezo actuator 60 and the movement mechanism 14, the movement mechanism 14 can be so strongly cooled by the cooling medium which, for example, is matched to a target temperature of the piezo actuator, that it is not possible to alone compensate for wear of parts of the movement mechanism 14 using the frictional heat that occurs. In order to nevertheless combine the advantage of a structural simplification of the cooling device with the highest possible dosing precision, a thermally induced expansion of a subregion of the movement mechanism 14 can be brought about in a targeted manner. For this purpose, the housing 11 comprises a heating device 51, here a heating cartridge 51, which can be activated by the control unit 90 by means of heating cartridge connection cables 92. The heat generated by the heating cartridge 51 leads, for example, by means of conduction and/or thermal radiation to heating at least one subregion of the movement mechanism 14, for example, the region of the lever 16 ("lever head") resting on the tappet head 33 and/or to heating of the housing 11 and thus to a corresponding change in length of the housing material.

In FIG. 1, a temperature sensor 52 is arranged in the housing 11 in the immediate vicinity of the heating cartridge 51 and is coupled to the control unit 90 by means of temperature sensor connection cables 86. The data determined by the temperature sensor 52 can be used to detect a temperature in a region of the housing 11. The control unit 90 can activate the heating cartridge 51 such that the housing 11, particularly a region of the housing 11 that encompasses the action chamber 13, is heated to a target temperature with the cooling medium despite the direct cooling of the movement mechanism 14 ("overlapping regulation") to achieve a desired thermally induced expansion of the housing 11. The thermally induced expansion can, for example, lead to a length of the housing 11, which here corresponds to the vertical extension of the housing 11, increasing by a desired amount. As a result, a location or position of the movement mechanism 14 with respect to the piezo actuator 60 can also be (relatively) changed. This changes the position of the lever 16 in relation to the discharge element 31, since the distance between the lever bearing 18 and the piezo actuator 60 is also influenced thereby, and thus in turn the distance between the discharge element 31 and the nozzle 40 of the dosing system 1.

In the region of the action chamber 13 is further arranged a motion sensor 53, for example, a thermally compensated Hall sensor 53, which interacts with a magnet in the region of the "lever head" (not shown) in order to determine a predominantly vertical movement of the "lever head" as a result of a deflection of the piezo actuator 60. The vertical movement of the "lever head" substantially corresponds to a (vertical) stroke of the tappet 31. The data from Hall sensor 53 (travel measurement per tappet stroke) are fed to control unit 90. Conclusions can be drawn about the actual distance between the tappet tip 32 and the nozzle 40 or nozzle seat 43 in the open state of the dosing system (as a state parameter) by means of this data. The control unit 90 can, for example, taking into account the data of the temperature sensor 52 and the Hall sensor 53, control the heating cartridge 51 so that a target stroke of the tappet 31 is kept stable despite wear of the components of the movement mechanism 14 and/or the tappet 31 even during the direct cooling of the movement mechanism 14.

The housing 11 comprises a vertically running air-filled slot 50 in order to thermally decouple the heating cartridge 51 from the piezo actuator 60 to be cooled. The heat generated by the heating cartridge 51 is thus predominantly directed in the direction of the movement mechanism 14. Thermal decoupling of the actuator chamber 12 from the action chamber 13 can also be provided (FIG. 2), depending on the embodiment of the dosing system 1.

FIG. 2 shows parts of a dosing system according to another embodiment of the invention. The fluidic unit here and also in FIGS. 3 and 4 corresponds to the structure according to the fluidic unit from FIG. 1, so that this assembly is only partially shown in the following for the sake of better clarity. The control unit and the corresponding cables for making contact with the piezo actuator or the heating cartridge and the temperature sensor in the housing are also not shown below or only partially shown in order to avoid repetitions.

An essential difference to the embodiment according to FIG. 1 is that the cooling device 2 of the dosing system 1 here (FIG. 2) comprises two separately configured and activatable cooling circuits in order to cool the piezo actuator 60 directly, independently or separately from the movement mechanism 14. A first cooling circuit of the cooling device 2 is configured to cool the piezo actuator 60 directly, wherein the cooling circuit comprises a supply device 21 having an inflow channel 26 and a discharge device 25 interacting therewith having an outflow channel 27 in the lower region of the actuator chamber 12.

In order to decouple the cooling of the piezo actuator 60 from the cooling of the movement mechanism 14, at least one O-ring 54 is arranged between a foot region of the piezo actuator 60, for example, a circular plate on which the piezo actuator 60 is fastened, and an inner wall of the actuator chamber 12. The O-ring 54 thus delimits the actuator chamber 12 towards the bottom and forms a barrier for the cooling medium. In this embodiment, the O-ring 54 is part of the cooling device 2. Due to the subdivision, a chamber is configured below the O-ring 54 in the region of the lever bearing 18, the chamber no longer being included in the cooling circuit of the actuator chamber 12. This chamber is connected to the action chamber 13 by means of the breakthrough 15 and is therefore regarded in this embodiment as part of the action chamber 13, thus, as a chamber 13 surrounding a movement mechanism 14 of the dosing system 1.

The cooling device 2 here comprises a second, separate cooling circuit for the direct cooling of at least one subregion of the movement mechanism 14. For this purpose, the (expanded) action chamber 13 has its own supply device 24 having an inflow channel 26 for a precooled cooling medium and a discharge device 22 interacting therewith having an outflow channel 27.

The cooling device 2 can be controlled by means of the control unit (not shown here) such that the two cooling circuits are separately supplied with cooling medium by means of the independently configured supply device 21 or 24. For example, the respective volume flow and the respective temperature of the supplied cooling medium can be adapted as required to a respective situation of the piezo actuator 60 or the movement mechanism 14. Less intense cooling of the movement mechanism 14 can lead to the frictional heat of the movement mechanism 14 alone being sufficient to compensate for wear.

The housing 11 here further comprises a horizontal air-filled slot 50 in order to thermally decouple the piezo actuator 60, which is typically more strongly cooled than the movement mechanism 14, from the movement mechanism 14. Undesired thermal interactions between the two cooling circuits can be reduced in this way.

FIG. 3 shows a further embodiment of a dosing system which, with regard to the cooling device, substantially corresponds to that from FIG. 1. However, the piezo actuator here comprises an actuator housing 62 in which a piezo stack is hermetically sealed. The wiring of the piezo actuator or the piezo stack takes place here by means of the two outer contact pins 61 (see also FIG. 6). The two contact pins 61 shown in the middle here are used to transmit the measured values of a number of temperature sensors of the piezo actuator or of the piezo stack from the actuator casing 62 to the control unit (not shown). For this purpose, the contact pins 61 are each connected to the control unit by means of temperature sensor connecting cables 86 on the one hand and to one or a plurality of temperature sensors (not shown) in the actuator casing 62 on the other hand.

The embodiment shown in FIG. 4 substantially corresponds to the dosing system from FIG. 2. However, as already explained for FIG. 3, a piezo stack encapsulated in an actuator casing 62 is arranged in the actuator chamber 12 here as well. In this embodiment, by means of a first cooling circuit of the cooling device 2, cooling medium directly acts upon a number of subregions of a surface or the outside of the actuator casing 62 facing the actuator chamber 12. The precooled cooling medium, as said, acts upon at least one subregion of the movement mechanism 14 by means of a second cooling circuit of the cooling device 2.

FIG. 5 shows in detail part of an actuator unit having an encapsulated piezo actuator for a dosing system according to an embodiment of the invention. The actuator casing 62 having the piezo stack encapsulated therein is arranged in the actuator chamber 12 such that the actuator casing 62 directly adjoins an inner side 80 of the wall 79 of the actuator chamber 12 at least in the region of bulges 82. Periodically, substantially horizontally running indentations 83 are arranged between the respective bulges 82 of the actuator casing 62.

The cooling device 2 here comprises a cooling medium supply line 84 which is coupled to a pump 28 of a feed device 21. Alternatively, the cooling medium supply line 84 could also be coupled to an adjustable cooling air supply (not shown) of the supply device 21. To regulate the cooling output, the pump 28 can be activated by the control unit 90 by means of a control connection 29. In order to feed the cooling medium to the actuator chamber 12, the pump 28 is connected to an inflow channel 26 for cooling medium by means of the supply device 21.

The inflow channel 26 of the cooling device 2 runs here directly along an outer side 81 of the chamber wall 79, that is, the inflow channel 26 is delimited by the outer side 81 of the chamber wall 79 and the housing 11. The inflow channel 26 has a number of breakthroughs 88 or openings 88 in the chamber wall 79 along the actuator chamber 12. A respective breakthrough 88 thus represents a connection between the inflow channel 26 and the actuator chamber 12.

For direct cooling of a number of subregions of the actuator casing 62, the latter is positioned in the actuator chamber 12 such that in each case a breakthrough 88 between the inflow channel 26 and the actuator chamber 12 and a breakthrough 88' interacting therewith (depicted here on the left) between the actuator chamber 12 and an outflow channel 27 are arranged in a horizontal plane with a single channel 83 in the actuator casing 62.

The gaseous and/or liquid cooling medium flowing into the actuator chamber 12 through a respective breakthrough 88 from the inflow channel 26 is thus guided substantially horizontally along the actuator casing 62 along a respective channel 83, which is vertically delimited by the adjacent bulges 82, and finally arrives into the outflow channel 27 or, by means of the discharge device 25, into a cooling medium discharge line 85 of the cooling device 2. A number of subregions of the actuator casing 62 are thus cooled directly in this embodiment. In order to also effectively cool the encapsulated piezo stack, a heat-conducting medium can be arranged in the actuator casing 62, as is explained with reference to FIG. 6.

FIG. 6 shows in detail a possible embodiment of an encapsulated piezo actuator for use in a dosing system. The piezoelectrically active material 67, thus, the piezo stack 67, is arranged between a cover 64 and a base 63 of the actuator casing 62 and is laterally surrounded by a fold-like jacket 74. The jacket 74 is fixedly connected to the cover 64 and the base 63 in order to hermetically seal off the piezo stack 67 from its surroundings. The cover 64 comprises four glass feedthroughs 65 (only one shown here), by means of which a contact pin 61 is guided hermetically sealed and electrically insulated from the interior of the actuator casing 62 to the outside of the actuator casing 62. A contact pin 61 is connected to an outer electrode 70 of the piezo stack 67, for example, soldered, to wire the piezo stack 67. A total of two outer electrodes 70 run on two opposite sides of the piezo stack 67 along its longitudinal extent between the two inactive head or foot regions 73 on the outside or surface 77 of the piezo stack 67.

Four temperature sensors 78 are arranged in the actuator casing 62; three of them on the surface 77 of the piezo stack 67 along the longitudinal extent of the piezo stack 67 and a further one in measuring contact with the jacket 74 or the inner wall 74 of the actuator casing 62. A respective temperature sensor 78 can usually be connected to two contact pins 61 (not shown here) in each case in order to generate measured values or to transmit them to the control unit. To transmit the measurement signals of a plurality of temperature sensors 78 to the control unit, the individual sensor signals can also be placed on just one contact pin 61 and modulated in a suitable manner, provided that the temperature sensors 78 are bus-compatible IC temperature sensors.

In the actuator casing 62, a strain gauge 87 is further arranged on the surface 77 of the piezo stack 67. The strain gauge 87 extends here substantially along the entire longitudinal extent of the encapsulated piezo stack 67, thus, between an inactive foot or head region 73. The corresponding measured values (state parameters) of the strain gauge 87 can be transmitted to the control unit of the dosing system by means of contact pins 61 (not shown). A further strain gauge 87 is arranged on the outside of the actuator casing 62, wherein the strain gauge 87 extends there between the base 63 and the cover 64 and can thus detect a total deflection, particularly also a temperature-related change in length, of the encapsulated piezo stack 67.

In order to effectively cool the piezo stack 67 despite the encapsulation, the actuator casing 62 comprises a liquid and/or solid filling medium 75, which efficiently removes the heat generated during operation from the surface 77 and transfers it to a region of the actuator casing 62, the region being included in the direct cooling by means of the cooling device. The filling medium can also comprise a moisture suppressing medium. The actuator casing 62 further comprises an expansion region 76, for example, a gas bubble 76 or a gas-filled region 76.

FIG. 7 shows schematically the structure of a cooling device 2 according to an embodiment of the dosing system for direct cooling of a number of subregions of the piezo actuator or the movement mechanism. The control unit 90 activates a cold generating device 55 of the cooling device 2, for example, a compression refrigeration machine 55, as a function of at least one state parameter of the dosing system 1 so that the cooling medium is cooled to a specific (first) temperature. The cooling medium, for example, compressed room air, is supplied to the refrigeration machine 55 by means of a cooling medium supply—KMZ. The cooling medium emerging from the refrigeration machine 55 has already been cooled to a temperature below the ambient temperature of the dosing system 1 and reaches a downstream vortex tube 57 of the cooling device 2 by means of suitable insulated lines.

In order to cool the previously controlled cooling medium in a targeted manner to a final (target) temperature by means of the vortex tube 57, the vortex tube 57 comprises a controllable regulating valve 94 in the region of a hot air outlet HAW of the vortex tube 57. Both the temperature and the (volume) flow of the cooled cooling medium ("cold air component") can be regulated by means of the valve 94. In principle, opening the valve leads to a reduction in the flow as well as the temperature of the cooled air emerging from the vortex tube 57. The cooled cooling medium leaves the respective vortex tube 57 at a cold air outlet of the vortex tube 57 in a direction SKM. A "hot air component" of the vortex tube is led away from the vortex tube 57 or dosing system 1 by means of the hot air outlet HAW. To regulate the volume flow of the cooling medium entering the vortex tube 57, a proportional valve 56 can be connected upstream of the vortex tube 57, the proportional valve being able to be activated by means of the control unit 90.

In the embodiment of the cooling device 2 shown here, the cooling medium is introduced into the housing 11 of the dosing system 1 by means of a cooling medium supply line 84, which is coupled to the vortex tube 57 on the one hand and to a supply device 21 on the other hand, in order to jointly cool a number of subregions of the piezo actuator and of the movement mechanism ("combined cooling). A controllable pressure reducer 59 is provided here between the vortex tube 57 and the supply device 21.

The actuators described above, the controllable compression refrigeration machine 55, the proportional valves 56, the pressure reducer 59 and the controllable regulating valves 94, can be used individually or in addition. The shown arrangement of the cooling circuit thus shows an almost maximum stage of extension in order to describe the individual components in their function.

If the cooling device 2 comprises two separate cooling circuits other than shown here, a first vortex tube 57 can be provided for the needs-based cooling of the piezo actuator and a second vortex tube 57 for the needs-based cooling of the movement mechanism.

The cooling medium is guided through the housing 11 by means of the cooling device 2 such that a number of subregions of the piezo actuator and the movement mechanism are cooled directly. The cooling medium, which may have warmed up as a result of the heat dissipation from the piezo actuator or movement mechanism, is then removed from the housing 11 by means of at least one discharge device 22 or a cooling medium discharge line 85 or is carried away from the actuator unit 10 in the region of a hot air outlet HAD. A further pressure reducer 59 is arranged here in the region of the hot air outlet HAD.

The pressure reducers 59 are shown here as optional components of the cooling device 2. In principle, the proportional valve 56 is already configured to set, for example, reduce, the pressure in the cooling medium supply line 84 or in the cooling circuit via the enabled flow through the vortex tube 57. Furthermore, the flow of cooling medium through vortex tube 57 and the division into a hot air part and a cold air part also lead to a pressure reduction.

The housing 11 comprises a heating cartridge 51 which can be controlled by means of the control unit 90 such that at least one subregion of the movement mechanism is heated to a (target) temperature. Furthermore, a number of temperature sensors 78, 52 are arranged in the actuator unit 10 in order to detect a temperature of at least one subregion of the piezo actuator or the movement mechanism. The corresponding data are fed to the control unit 90 as a state parameter of the dosing system.

As a function of these or further state parameters, the control unit 90 can calculate or carry out temperature management of the dosing system in order to achieve the constant highest possible level of dosing precision. For this purpose, the control unit 90 can apply appropriate control signals to the individual components of the cooling device 2, thus, the refrigeration machine 55, the proportional valve 56, the vortex tube 57 or the regulating valve 94, the pressure reducer 59, the heating cartridge 51 and optionally further components.

Finally, it is pointed out once again that the dosing systems described in detail above are merely embodiments which can be modified in the most varied of ways by the person skilled in the art without departing from the scope of the invention. For example, a single refrigeration machine can thus be coupled to a plurality of vortex tubes. Furthermore, the use of the indefinite article "a" or "an" does not exclude the possibility that the relevant characteristics can also be present several times.

LIST OF REFERENCE SYMBOLS

1 dosing system
2 cooling device
10 actuator unit

11 housing actuator unit
12 actuator chamber
13 action chamber
14 movement mechanism
15 breakthrough
16 lever
17 lever contact surface
18 lever bearing
19 actuator spring
20 pressure piece
21 supply device/actuator chamber
22 discharge device/action chamber
23 fixing screw
24 supply device/action chamber
25 discharge device/actuator chamber
26 inflow channel
27 outflow channel
28 pump
29 pump control connection
30 fluidic unit
31 tappet
32 tappet tip
33 tappet head
34 tappet contact surface
35 tappet spring
36 tappet seal
37 tappet bearing
40 nozzle
41 nozzle opening
42 nozzle chamber
43 sealing seat
44 feed channel
45 reservoir interface
46 medium reservoir
47 frame part
48 heating device fluidic unit
49 heating connection cable
50 slit/housing
51 heating cartridge actuator unit
52 temperature sensor/housing
53 Hall sensor
54 O-ring
55 refrigeration machine
56 proportional valve; throttle valve
57 vortex tube
59 pressure reducer
60 piezo actuator
61 contact pin
62 piezo actuator housing; actuator casing
63 base (actuator casing)
64 cover (actuator casing)
65 glass feedthrough
66 piezo actuator control connections
67 piezo stack
70 outer electrode
73 inactive region
74 jacket (actuator casing)
75 filling medium
76 expansion region
77 actuator surface
78 temperature sensor piezo actuator
79 chamber wall
80 inside of chamber wall
81 outside of chamber wall
82 bulge of actuator casing
83 indentation of actuator casing
84 cooling medium supply line
85 cooling medium discharge line
86 temperature sensor connection cable
87 strain gauge
88, 88' breakthrough
90 control unit
91 control unit connection cable
92 heating cartridge connection cable
94 regulating valve vortex tube
HAD hot air outlet dosing system
HAW hot air outlet vortex tube
K tilt axis
KMZ cooling medium supply
R discharge direction
SKM flow direction cooling medium

The invention claimed is:

1. A dosing system for a dosing material having a nozzle, a feed channel for the dosing material, a discharge element, an actuator unit that is coupled to the discharge element and/or the nozzle and has a piezo actuator, and a cooling device, the cooling device comprising:

a supply device for feeding a precooled cooling medium into a housing of the dosing system, the cooling device being configured for direct cooling by means of the precooled cooling medium of at least one subregion of the piezo actuator and/or at least one subregion of a movement mechanism coupled to the piezo actuator.

2. The dosing system according to claim 1, wherein the piezo actuator comprises an actuator housing in which piezo elements are encapsulated.

3. The dosing system according to claim 1, wherein the cooling device is configured to control and/or to regulate the cooling of at least one subregion of the piezo actuator and/or at least one subregion of the movement mechanism coupled to the piezo actuator as a function of at least one state parameter.

4. The dosing system according to claim 3, wherein the at least one state parameter is a temperature in at least one subregion of the piezo actuator and/or a temperature in at least one subregion of the movement mechanism coupled to the piezo actuator.

5. The dosing system for a dosing material having a nozzle, a feed channel for the dosing material, a discharge element, an actuator unit that is coupled to the discharge element and/or the nozzle and has a piezo actuator, and a cooling device which is configured to cool at least one subregion of the piezo actuator and/or at least one subregion of a movement mechanism coupled to the piezo actuator in a controlled and/or regulated manner as a function of at least one state parameter, according to claim 3, wherein the at least one state parameter is a length of at least one subregion of the piezo actuator and/or a distance between the discharge element and the nozzle of the dosing system and/or a dosing amount.

6. The dosing system according to claim 3, wherein the dosing system comprises a temperature sensor and/or a strain sensor and/or a movement sensor for determining the state parameter.

7. The dosing system according to claim 1, wherein the cooling device is configured to control and/or regulate the cooling of at least one subregion of the piezo actuator separately.

8. The dosing system according to claim 1, wherein the precooled cooling medium is configured to cool at least one subregion of the piezo actuator and/or at least one subregion of the movement mechanism coupled to the piezo actuator to a target temperature.

9. The dosing system according to claim 1, wherein the cooling device for cooling the cooling medium comprises at least one cold generating device.

10. The dosing system according to claim 9, wherein the cold generating device is configured to cool the cooling medium to a predeterminable temperature.

11. The dosing system according to claim 9, wherein the cold generating device comprises a vortex tube.

12. The dosing system according to claim 1, wherein at least one subregion of the movement mechanism coupled to the piezo actuator comprises a heating device for heating at least one subregion of the movement mechanism coupled to the piezo actuator.

13. The dosing system according to claim 12, wherein the heating device is configured to keep at least one of the following state parameters constant in cooperation with the cooling device of the dosing system:

a temperature in at least one subregion of the piezo actuator and/or in at least one subregion of the movement mechanism coupled to the piezo actuator, a length of at least one subregion of the piezo actuator, a distance between the discharge element and the nozzle, a dosing amount of the dosing material.

14. A method for operating a dosing system for the dosing of dosing material, the dosing system comprising a nozzle, a feed channel for the dosing material, a discharge element, an actuator unit that is coupled to the discharge element and/or the nozzle and has a piezo actuator, and a cooling device, a housing of the dosing system being fed a precooled cooling medium by means of a supply device of the cooling device, and at least one subregion of the piezo actuator and/or at least one subregion of a movement mechanism coupled to the piezo actuator being cooled directly by the cooling device by means of the precooled cooling medium.

15. A method for manufacturing a dosing system for the dosing of a dosing material having an actuator unit having a piezo actuator, the dosing system being equipped with a cooling device, the cooling device being equipped with a supply device for feeding a precooled cooling medium into a housing of the dosing system, and the dosing system being configured so that at least one subregion of the piezo actuator and/or at least one subregion of a movement mechanism coupled to the piezo actuator is cooled directly by means of the precooled cooling medium.

16. A dosing system for a dosing material having a nozzle, a feed channel for the dosing material, a discharge element, an actuator unit that is coupled to the discharge element and/or the nozzle and has a piezo actuator, and a cooling device which is configured to cool at least one subregion of the piezo actuator and/or at least one subregion of a movement mechanism coupled to the piezo actuator in a controlled and/or regulated manner as a function of at least one state parameter, wherein the at least one state parameter is a length of at least one subregion of the piezo actuator and/or a distance between the discharge element and the nozzle of the dosing system and/or a dosing amount.

17. The dosing system according to claim 11, wherein the vortex tube comprises an adjustable valve for regulating the temperature of the cooling medium.

* * * * *